US008581685B2

(12) United States Patent
Ono

(10) Patent No.: US 8,581,685 B2
(45) Date of Patent: Nov. 12, 2013

(54) REACTOR AND METHOD FOR MANUFACTURING REACTOR

(75) Inventor: Hiroshi Ono, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 0 days.

(21) Appl. No.: 13/071,129

(22) Filed: Mar. 24, 2011

(65) Prior Publication Data

US 2011/0234359 A1 Sep. 29, 2011

(30) Foreign Application Priority Data

Mar. 29, 2010 (JP) ..... 2010-075062

(51) Int. Cl.

| | |
|---|---|
| ***H01F 27/24*** | (2006.01) |
| ***H01F 17/06*** | (2006.01) |
| ***H01F 27/30*** | (2006.01) |
| ***H01F 17/04*** | (2006.01) |

(52) U.S. Cl.

USPC ..... 336/221; 336/178; 336/205; 336/212

(58) Field of Classification Search

USPC ..... 336/220–222, 98, 178, 182, 184, 205, 336/209, 212, 208; 29/602.1, 605, 606

See application file for complete search history.

(56) References Cited

U.S. PATENT DOCUMENTS

| | | | | |
|---|---|---|---|---|
| 2,628,342 | A * | 2/1953 | Taylor | 336/45 |
| 2,856,639 | A * | 10/1958 | Forrest et al. | 264/272.19 |
| 3,525,966 | A * | 8/1970 | Wierzbinski | 336/205 |
| 4,095,206 | A * | 6/1978 | Hishiki | 336/96 |
| 5,426,846 | A * | 6/1995 | White et al. | 29/609 |
| 5,926,946 | A * | 7/1999 | Minato et al. | 29/606 |
| 6,600,402 | B1 * | 7/2003 | LaFleur et al. | 336/61 |
| 2012/0092120 | A1 * | 4/2012 | Yoshikawa et al. | 336/220 |

FOREIGN PATENT DOCUMENTS

| | | | |
|---|---|---|---|
| EP | 2 315 220 | A1 | 4/2011 |
| JP | 02-194508 | A * | 8/1990 |
| JP | 8-138954 | A | 5/1996 |
| JP | 2003-124039 | A | 4/2003 |
| JP | 2009-218293 | A | 9/2009 |
| JP | 2009-246221 | A | 10/2009 |
| JP | 2010-251364 | A | 11/2010 |
| WO | WO2010/110007 | A1 * | 9/2010 |

OTHER PUBLICATIONS

European Search Report dated Jul. 22, 2011 in counterpart Patent Application No. 11159131.9.

Notice of Reasons for Rejection for Japanese Application No. 2010-075062, mailed Feb. 5, 2013, with English Translation thereof.

* cited by examiner

*Primary Examiner* — Lincoln Donovan
*Assistant Examiner* — Mangtin Lian
(74) *Attorney, Agent, or Firm* — Sughrue Mion, PLLC

(57) ABSTRACT

A reactor includes: a first core having end surfaces; a second core having end surfaces facing the end surfaces of the first core; coils wound around at least part of the circumference of the first core and the second core; and gap members arranged between the end surfaces of the first core and the end surfaces of the second core. The coils and the gap members are integrally molded with a first resin in a state where the first and second cores are not provided. The coils and the first and second cores are integrally molded with a second resin in a state where the gap members are sandwiched between the end surfaces of the first core and the end surfaces of the second core.

5 Claims, 4 Drawing Sheets

REACTOR AND METHOD FOR MANUFACTURING REACTOR

BACKGROUND OF THE INVENTION

The present invention relates to a reactor and a method for manufacturing the reactor.

Japanese Laid-Open Patent Publication No. 2003-124039 discloses a reactor in which end surfaces of cores face each other with a gap plate located in between.

If the gap plate is secured to the end surfaces of the cores with adhesive to hold the gap plate, adhesive and a process for adhering the gap plate are necessary, which increases costs.

SUMMARY OF THE INVENTION

Accordingly, it is an objective of the present invention to provide a reactor and a method for manufacturing a reactor having increased rigidity without arranging a gap member by adhesion.

To achieve the above objective, one aspect of the present invention provides a reactor, which includes a first core, a second core, coils, a gap member, a first resin, and a second resin. The first core has an end surface. The second core has an end surface facing the end surface of the first core. The coils are wound around at least part of the circumference of the first core and the second core. The gap member is arranged between the end surface of the first core and the end surface of the second core. The first resin integrally molds the coils and the gap member in a state where the first and second cores are not present. The second resin integrally molds the coils and the first and second cores in a state where the gap member is sandwiched between the end surface of the first core and the end surface of the second core.

Another aspect of the present invention provides a method for manufacturing a reactor, which includes: preparing a first core having an end surface, a second core having an end surface, and coils; integrally molding the coils and a gap member with a first resin; inserting first and second cores into the coils such that the gap member is sandwiched between the end surface of the first core and the end surface of the second core; and integrally molding the coils and the first and second cores with a second resin in a state where the first and second cores are inserted in the coils.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

One embodiment of the present invention will now be described with reference to the drawings.

Figure 1:
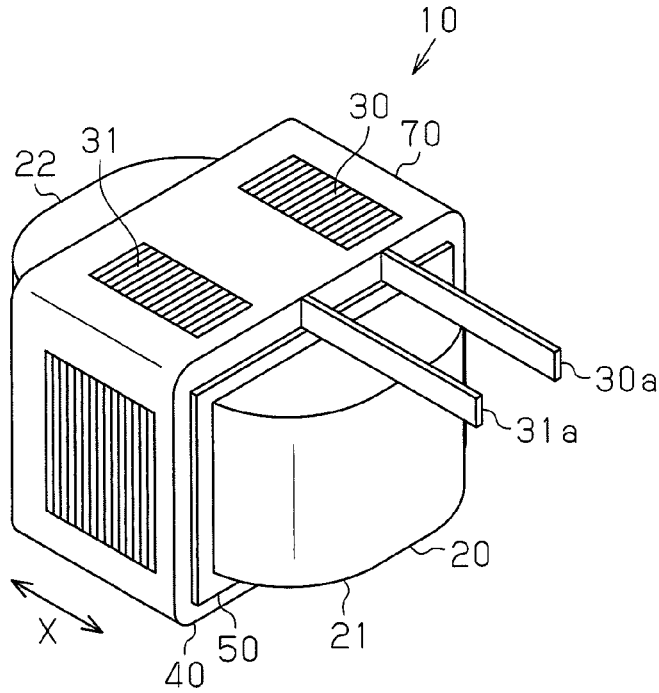
FIG. 1 is a perspective view illustrating a reactor according to one embodiment of the present invention.

A reactor 10 shown in FIG. 1 uses a UU core 20. The UU core 20 includes a first core, which is a U core 21 in this embodiment, and a second core, which is a U core 22 in this embodiment.

Figure 2:
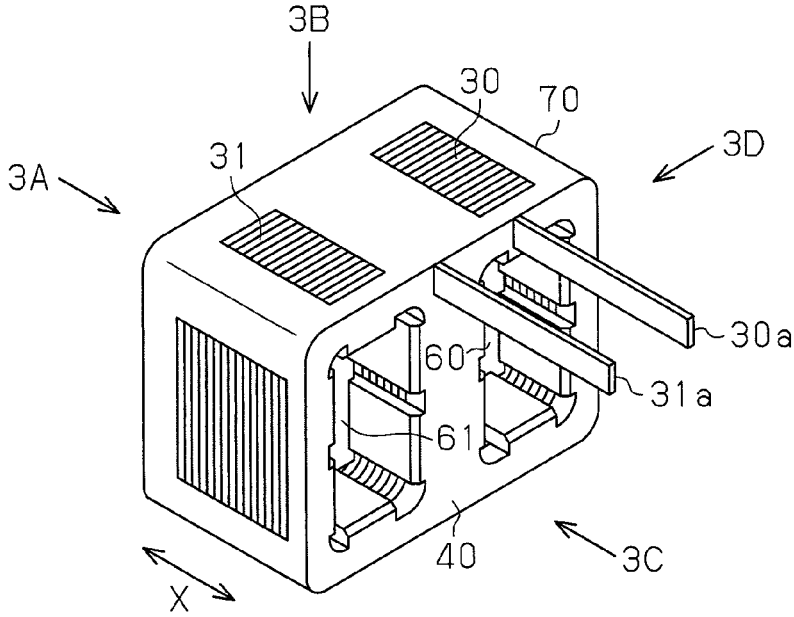
FIG. 2 is a perspective view illustrating the coil assembly shown in FIG. 1.
Figure 3A:
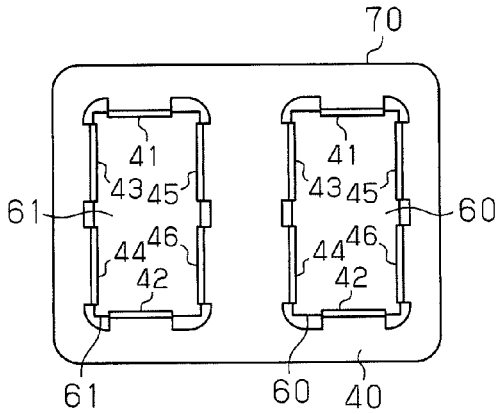
FIG. 3A is a diagram illustrating the coil assembly of FIG. 2 as viewed from the direction along arrow 3A.
Figure 3C:
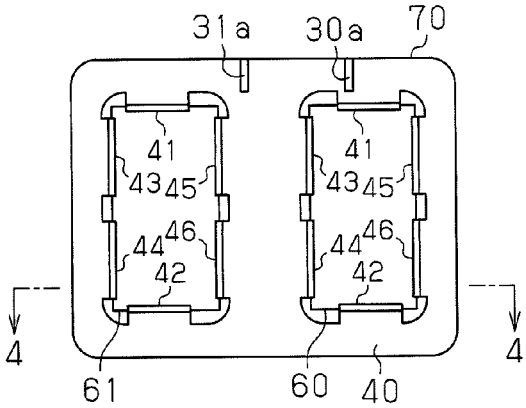
FIG. 3C is a diagram illustrating the coil assembly of FIG. 2 as viewed from the direction along arrow 3C.
Figure 3B:
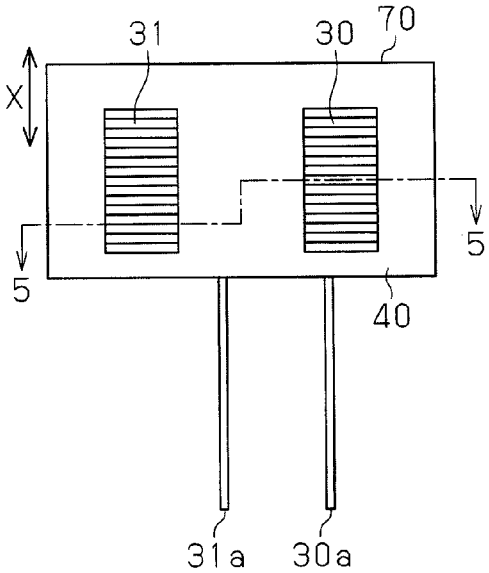
FIG. 3B is a diagram illustrating the coil assembly of FIG. 2 as viewed from the direction along arrow 3B.
Figure 3D:
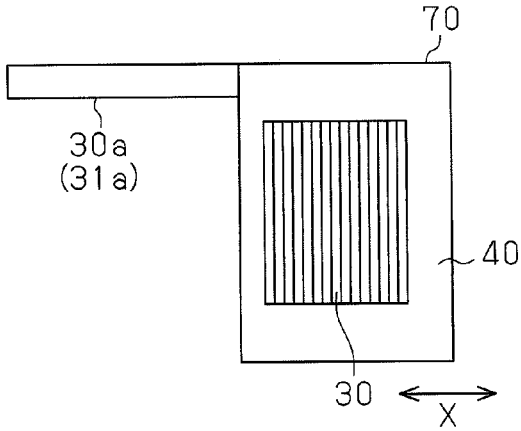
FIG. 3D is a diagram illustrating the coil assembly of FIG. 2 as viewed from the direction along arrow 3D.

The reactor 10 includes the UU core 20 (the U core 21 and the U core 22) and coils 30, 31. The coils 30, 31 are provided in a coil assembly 70. As shown in FIG. 2, the coil assembly 70 is formed by integrally molding the coils 30, 31 with a resin 40 in a state where gap members, which are ceramic gap plates 60, 61 in this embodiment, are arranged in the two coils 30, 31. The reactor 10 shown in FIG. 1 is formed by mounting the U cores 21, 22 to the coil assembly 70, and further integrally molding the coil assembly 70 with a resin 50.

Figure 4:
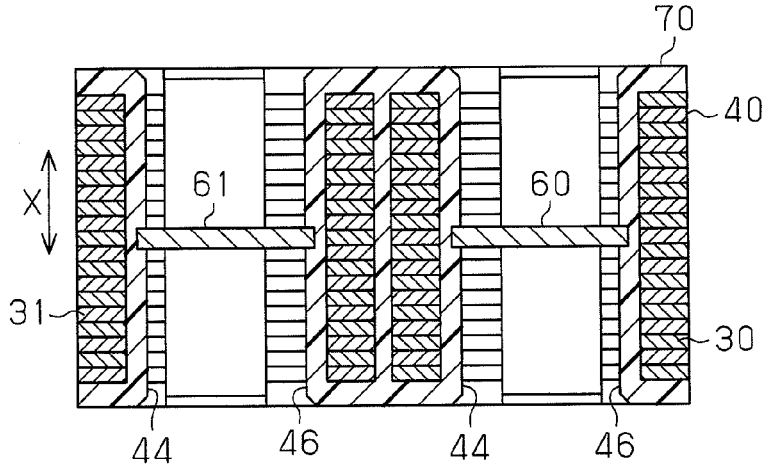
FIG. 4 is a cross-sectional view taken along line 4-4 in FIG. 3C.
Figure 5:
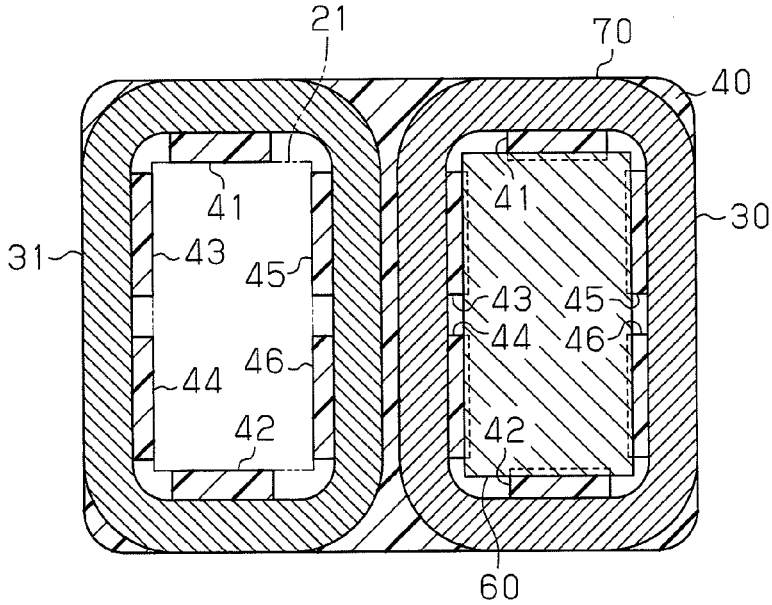
FIG. 5 is a cross-sectional view taken along line 5-5 in FIG. 3B.

FIGS. 3A to 3D are diagrams illustrating the coil assembly 70 of FIG. 2 as viewed from the directions along arrows 3A to 3D. FIG. 4 shows a cross-sectional view taken along line 4-4 in FIG. 3C. Furthermore, FIG. 5 shows a cross-sectional view taken along line 5-5 in FIG. 3B.

Figure 6:
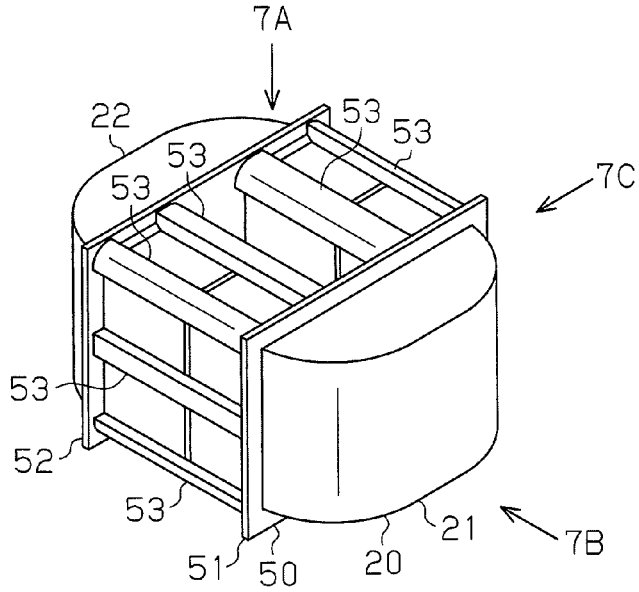
FIG. 6 is a perspective view illustrating the cores and the second molded resin shown in FIG. 1.
Figure 7A:
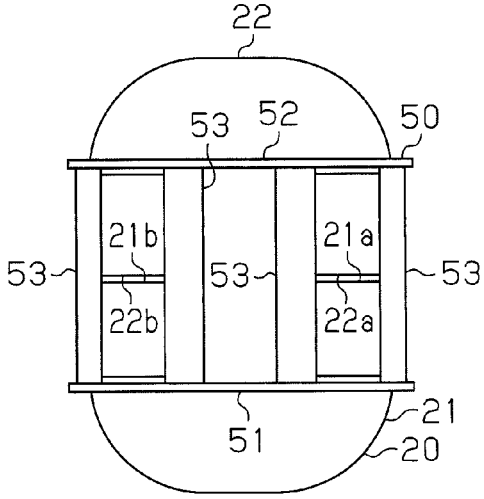
FIG. 7A is a diagram as viewed from the direction along arrow 7A in FIG. 6.
Figure 7B:
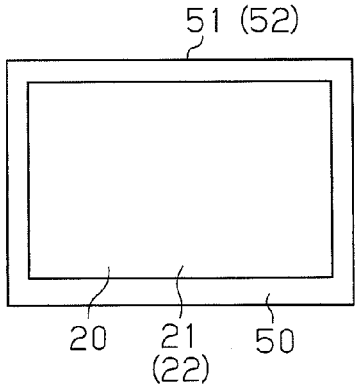
FIG. 7B is a diagram as viewed from the direction along arrow 7B in FIG. 6.
Figure 7C:
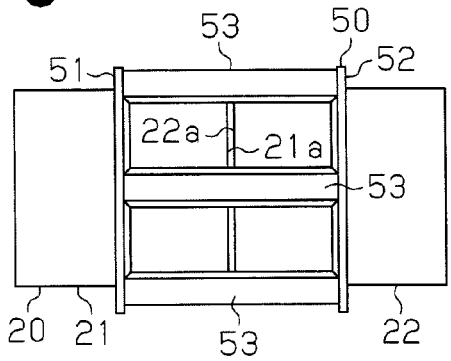
FIG. 7C is a diagram as viewed from the direction along arrow 7C in FIG. 6.

FIG. 6 shows the UU core 20 (the U core 21 and the U core 22) and the resin 50. The U cores 21, 22 are molded with the resin 50 and are coupled to each other. FIGS. 7A to 7C are diagrams illustrating the UU core 20 and the resin 50 shown in FIG. 6 as viewed along the directions of arrows 7A to 7C.

As shown in FIGS. 6 and 7A to 7C, the U core 21 is a rod having a rectangular cross-section, and forms a U-shape as a whole. The U core 21 includes end surfaces 21*a*, 21*b*. Similarly, the U core 22 is a rod having a rectangular cross-section, and forms a U-shape as a whole. The U core 22 includes end surfaces 22*a*, 22*b*.

A gap is formed between the end surfaces 21*a*, 22*a* of the U cores 21, 22, and a ceramic gap plate 60 (see FIGS. 4 and 5) is arranged in the gap. That is, the end surfaces 21*a*, 22*a* of the U cores 21, 22 face each other via the ceramic gap plate 60. Similarly, a gap is formed between the end surfaces 21*b*, 22*b* of the U cores 21, 22, and a ceramic gap plate 61 is arranged in the gap. That is, the end surfaces 21*b*, 22*b* of the U cores 21, 22 face each other via the ceramic gap plate 61. In this manner, the ceramic gap plates 60, 61 are inserted partway along a closed magnetic circuit formed by the UU core 20.

In the present embodiment, the ceramic gap plates 60, 61 function as the gap members. That is, the gap members are formed by separate members from the resin 40.

The coils 30, 31 (see FIG. 1) each have a rectangular ring shape. Each of the coils 30, 31 is wound about one of the two coupling portions between the U cores 21, 22. In this manner, the annular coils 30, 31 are wound about at least part of the circumference of the UU core 20 (the U core 21 and the U core 22).

The coils 30, 31 of the present embodiment are formed by winding a conductor, which is a flat wire having a rectangular cross-section, edgewise.

One end of the coil 30 is coupled to one end of the coil 31. The other end of the coil 30 includes a terminal 30*a*, and the other end of the coil 31 includes a terminal 31*a* (see FIGS. 2 and 3). The terminals 30*a*, 31*a* extend in the horizontal direction (an axial direction X of the coils 30, 31) in a state exposed from the resin 40.

As shown in FIGS. 2 to 5, the coils 30, 31 are coated with the resin 40, and the outer circumferential edges of the ceramic gap plates 60, 61 are also coated with the resin 40. That is, the coils 30, 31 are molded with the first resin, which is the resin 40 in this embodiment, in a state where the ceramic gap plates 60, 61 are arranged between the end surfaces 21*a*, 21*b* of the U core 21 and the end surfaces 22*a*, 22*b* of the U core 22.

Also, as shown in FIG. 1, the coils 30, 31 and the U cores 21, 22 are molded with the second resin, which is the resin 50 in this embodiment, in the state where the ceramic gap plates 60, 61 are sandwiched between the end surfaces 21*a*, 21*b* of the U core 21 and the end surfaces 22*a*, 22*b* of the U core 22.

As shown in FIG. 5, the resin 40, which integrally molds the coils 30, 31, includes protrusions 41 to 46, which protrude inward from the inner circumferential surfaces of the coils 30, 31. The protrusions 41 to 46 extend in the axial direction X of the coils 30, 31 (see FIGS. 1, 2, 3B, 3D, and 4). The protrusions 41 to 46 are integrated with the ceramic gap plates 60, 61 such that the rectangular ceramic gap plates 60, 61 are supported by the distal ends of the protrusions 41 to 46 inside the coils 30, 31.

Further, the protrusions 41 to 46 also function as a position determining sections for the U cores 21, 22. That is, as shown in FIG. 5, the outer surfaces of the U cores 21, 22 contact the distal ends of the protrusions 41 to 46 so that the positions of the U cores 21, 22 with respect to the coils 30, 31 are determined.

As shown in FIGS. 6 and 7, the resin 50 includes a rectangular frame 51, which is located on the outer circumferential surface of the U core 21, a rectangular frame 52, which is located on the outer circumferential surface of the U core 22, and rods 53, which couple the rectangular frames 51, 52 with each other. The rods 53 are arranged around and to extend over the U cores 21, 22 so as to couple the U cores 21, 22 with each other and support the U cores 21, 22. The rods 53 function as beams.

A method for manufacturing the reactor will now be described.

First, the coils 30, 31, the ceramic gap plates 60, 61, and the U cores 21, 22 are prepared.

The coils 30, 31 are then molded with resin 40, and simultaneously, the ceramic gap plates 60, 61 are molded together with the coils 30, 31. That is, the coils 30, 31 and the ceramic gap plates 60, 61 are integrally molded with the resin 40. The coil assembly 70 as shown in, for example, FIG. 2 is thus obtained.

Subsequently, the U cores 21, 22 are inserted in the coils 30, 31 of the coil assembly 70, and the ceramic gap plates 60, 61 are sandwiched between the opposing end surfaces 21*a*, 21*b*, 22*a*, 22*b* of the U cores 21, 22.

Since the protrusions 41 to 46 of the resin 40, which extend along the inner circumferential surface of the coils 30, 31 guide the U cores 21, 22, the U cores 21, 22 do not contact the coils 30, 31. As a result, the coils 30, 31 are prevented from being damaged during insertion of the cores.

The entire coil assembly 70 in which the U cores 21, 22 are inserted is molded with the resin 50.

As a result, the reactor 10 shown in FIG. 1 is manufactured.

The reactor 10 manufactured as described above uses the ceramic gap plates 60, 61. Thus, as compared to a case where resin gap plates are used, creeping caused by repeated stress (attractive force) generated between the U cores 21, 22 is reduced when used as the reactor. This increases the rigidity of the reactor 10 and reduces noise and vibration (NV).

Also, since the rods 53 are formed to extend over both U cores 21, 22 through molding with the resin 50 (by forming the beam structure), the overall rigidity is increased, and noise and vibration are reduced as compared to a case where gap plates are adhered to the core end surfaces with adhesive.

As described above, the rigidity is increased without adhesion or temporarily fixing.

Furthermore, the positions of the U cores 21, 22, the coils 30, 31, and the ceramic gap plates 60, 61 are strictly determined. As a result, coil losses and inductance (L) variations are reduced.

The present embodiment has the following advantages.

(1) The coils 30, 31 and the ceramic gap plates 60, 61 are integrally molded with the resin 40. The U cores 21, 22 are mounted on the obtained coil assembly 70, which is then molded with the resin 50. The gap members are therefore arranged without adhesion. Also, since adhesive and adhesion processes are unnecessary, the costs are reduced. Furthermore, the rigidity of the reactor 10 is improved by molding with the resins 40, 50.

(2) The resin 40 includes the protrusions 41 to 46, which serve as the position determining sections for the U cores 21, 22. Thus, the protrusions 41 to 46 determine the position of the U cores 21, 22.

(3) The resin 50 couples the U cores 21, 22 with each other and includes the rods (beams) 53, which support the U cores 21, 22. The gap plates are thus firmly secured between the cores as compared to a case where gap plates are adhered to the core end surfaces.

The ceramic gap plates 60, 61 are used as gap members. Instead, resin plates may be used as gap members, and the resin 40 may function as gap members. That is, when molding coils with the resin 40, gap members may be formed of the resin 40 by arranging part of the resin 40 in the gap.

The number of the protrusions 41 to 46 shown in FIG. 3 is not limited. That is, in FIG. 3A, the protrusion 41 is formed on the upper surface of the coil inner circumferential surface, the protrusion 42 is formed on the lower surface of the coil inner circumferential surface, the protrusions 43, 44 are formed on the upper and lower sections of the left surface of the coil inner circumferential surface, and the protrusions 45, 46 are formed on the upper and lower sections of the right surface of the coil inner circumferential surface. Instead, for example, a single protrusion may be formed on each of the upper, lower, left, and right surfaces of the coil inner circumferential surface.

What is claimed is:

1. A reactor comprising:

a first core having an end surface;

a second core having an end surface facing the end surface of the first core;

coils wound around at least part of the circumference of the first core and the second core;

a gap member arranged inside the wound coils and between the end surface of the first core and the end surface of the second core;

a coil assembly formed by the wound coils, the gap member, and a first resin that integrally couples the wound coils and the gap member, wherein the coil assembly and the first and second cores are integrally coupled by a second resin, at least a part of the second resin is arranged between the first core and the coil assembly and between the second core and the coil assembly, and the first resin includes one or more protrusions that extend along the inner circumferential surface of the wound coils and in the axial direction of the wound coils.

2. The reactor according to claim 1, wherein the first resin includes a position determining section for determining the position of the first core and second core with respect to the coils.

3. The reactor according to claim 1, wherein the second resin couples the first core and the second core with each other and includes a beam for supporting the cores.

4. The reactor according to claim 1, wherein the gap member is formed by a member separate from the first resin.

5. The reactor according to claim 1, wherein the gap member is formed of the first resin.

* * * * *